United States Patent [19]

Conrad et al.

[11] 4,452,504

[45] Jun. 5, 1984

[54] CROSS CONNECTION LINK FOR ESTABLISHING THE SAME PHASE BETWEEN ELECTRICAL TERMINAL BLOCKS

[75] Inventors: Horst Conrad; Wolfgang Kretzschmar; Peter E. Murray, all of Detmold, Fed. Rep. of Germany

[73] Assignee: C. A. Weidmüller GmbH & Co., Detmold, Fed. Rep. of Germany

[21] Appl. No.: 333,112

[22] Filed: Dec. 21, 1981

[30] Foreign Application Priority Data

Dec. 22, 1980 [DE] Fed. Rep. of Germany ..... 3048497

[51] Int. Cl.[3] ..... H01R 13/02

[52] U.S. Cl. ..... 339/263 R

[58] Field of Search ..... 339/263 R, 272 A, 272 UC

[56] References Cited

U.S. PATENT DOCUMENTS

| | | | |
|---|---|---|---|
| 1,204,691 | 11/1916 | Sachs | 339/263 R |
| 3,246,283 | 4/1966 | Huska | 339/272 UC |
| 3,609,654 | 9/1971 | Wallo | 339/263 R |
| 3,864,003 | 2/1975 | Boke | 339/263 R |
| 4,056,301 | 11/1977 | Norden | 339/263 R |
| 4,084,879 | 4/1978 | Lepow | 339/272 A |

FOREIGN PATENT DOCUMENTS

| | | | |
|---|---|---|---|
| 713146 | 11/1941 | Fed. Rep. of Germany | 339/272 UC |
| 2511385 | 9/1976 | Fed. Rep. of Germany | 339/272 A |
| 2514206 | 10/1976 | Fed. Rep. of Germany | 339/272 A |
| 141885 | 5/1980 | Fed. Rep. of Germany | 339/263 R |
| 144990 | 11/1980 | Fed. Rep. of Germany | 339/263 R |
| 542065 | 12/1941 | United Kingdom | 339/272 UC |

*Primary Examiner*—Joseph H. McGlynn

*Attorney, Agent, or Firm*—Peter K. Kontler

[57] ABSTRACT

A cross connection link which can establish several electrical connections between an elongated strip-shaped conductor and one or more bus bars in the recess of a terminal block has a series of neighboring L-shaped or U-shaped metallic distancing elements each of which has a leg connected with an edge portion of the strip-shaped conductor by a weakened joint so that it can be readily broken off the strip-shaped conductor, and a web which is integral with the other end portion of the leg and has an aperture for the shank of a screw serving to connect the web with a bus bar. The heads of the screws are adjacent to those sides of the webs which face the strip-shaped conductor, and such heads are confined against movement away from the regions of the respective webs so that they are always ready for engagement by the working end of a tool which is used to move the shanks of selected screws or all screws into mesh with tapped holes in the bus bar or bars. The confining means can constitute portions of the distancing elements or discrete cages consisting of electrically insulating material and connected to each other by an elongated enclosure which surrounds at least the major portion of the strip-shaped conductor.

33 Claims, 8 Drawing Figures

Fig. 7
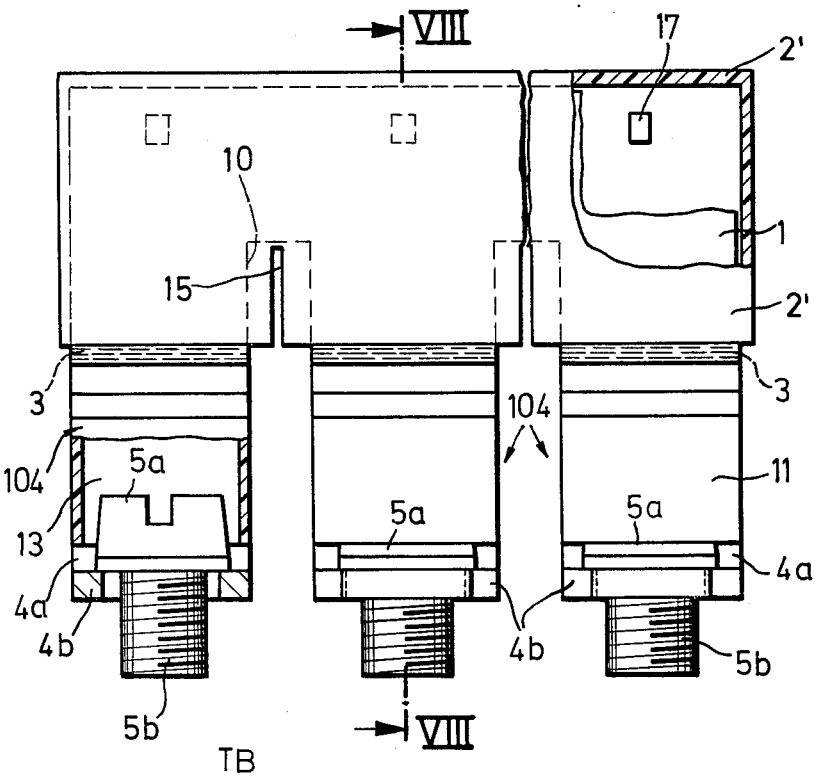
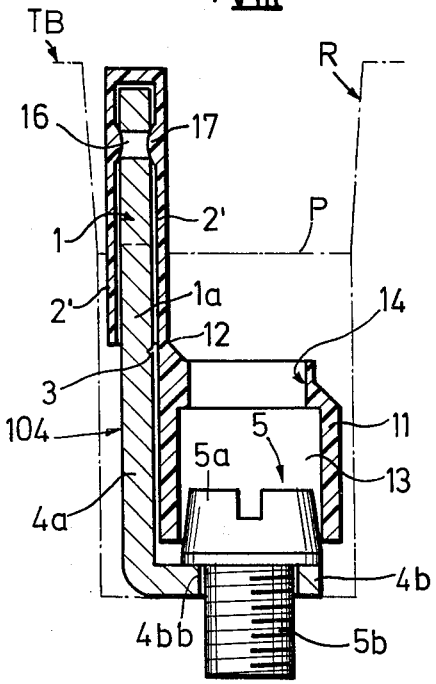
Fig. 8

CROSS CONNECTION LINK FOR ESTABLISHING THE SAME PHASE BETWEEN ELECTRICAL TERMINAL BLOCKS

BACKGROUND OF THE INVENTION

The present invention relates to cross connection links for establishing the same phase between modular terminal blocks, e.g., between one or more bus bars in the recess of a terminal block and one or more strip-shaped conductors carrying rows of neighboring distancing elements for connection to the bus bars by screws or analogous threaded fasteners.

It is already known to provide a cross connection link with several integral distancing elements which can be broken away from the conductor at predetermined locations so as to reduce the total number of connections between such cross connection link and one or more bus bars to a number which is less than the maximum number of distancing elements on the elongated conductor. Such links exhibit a number of important advantages in comparison with links wherein each of the distancing elements is a discrete part which must be connected to each of two spaced-apart conductors. Thus, a link wherein one of the conductors is integral with distancing elements can be inserted into the recess of a terminal block, and the installation can be completed by the simple expedient of connecting the shanks of selected screws with the adjacent bus bar(s). This simplifies the task of the workmen and results in considerable reduction of the time which is required to complete the assembly. The bus bar or bars are formed with tapped holes for reception of the shanks forming part of selected screws. Those distancing elements which are not needed (i.e., the distancing elements which need not be connected with the source of electrical energy by way of a bus bar) are simply broken off the respective conductor at the predetermined locations and are removed together with the corresponding screws or analogous fasteners.

German Offenlegungsschrift No. 23 57 052 discloses a cross connection link whose conductor is integral with the distancing elements and which completely or nearly completely fills the recess of the terminal block wherein the device is installed. Each distancing element comprises two shackles and constitutes a sleeve which has two openings an is deformable to such an extent that portions thereof yieldably engage the corresponding screw which must be introduced through an opening of the conductor. Such distancing elements are quite complex and must be produced in specially designed and hence expensive stamping and bending machines. Furthermore, each screw must have a relatively long shank, and the designer of the distancing elements must ensure that rotation of a screw in a direction to move its shank into mesh with a bus bar entails a predictable deformation of the distancing element in a predetermined direction. This, too, contributes to the initial cost of the cross connection link and to complexity of the installation in a terminal block or the like. Any other than predetermined deformation of the distancing elements would entail a reduction or elimination of their holding and/or guiding capabilities.

OBJECTS AND SUMMARY OF THE INVENTION

An object of the invention is to provide a very simple, compact and versatile cross connection link which can establish several connections between spaced apart electrical conductors, such as between an elongated strip-shaped first conductor and one or more bus bars which are installed in the recess of a modular terminal block.

Another object of the invention is to provide a link of the above outlined character which is provided with a row of aligned distancing elements capable of establishing electrical connections between the two conductors and also capable of being separated from the first conductor in a simple, time-saving and predictable manner with a minimum of effort and without resorting to special tools.

An additional object of the invention is to provide a link which is constructed and assembled in such a way that the component parts which are likely to be lost or misplaced are prevented from leaving the general area of their use.

Still another object of the invention is to provide a link of the above outlined character which can be installed in terminal blocks irrespective of the orientation of such blocks and which can be installed with a minimum of effort even if the recess of a terminal blocks faces downwardly so that a workman must manipulate the tools at a level above his or her head.

An additional object of the invention is to provide novel and improved distancing elements for use in a link of the above outlined character.

A further object of the invention is to provide a link which constitutes an improvement over the link disclosed in German Offenlengungsschrift No. 23 57 052.

An additional object of the invention is to provide the link with novel and improved means for insulating the first conductor from the surrounding or neighboring parts and to construct and assemble the insulating means in such a way that it can perform one or more additional useful and advantageous functions.

The invention resides in the provision of a link for establishing the same electrical phase between several modular terminal blocks. The improved link comprises an elongated first conductor, a battery of aligned neighboring distancing elements each of which has a leg integral with an elongated edge portion of the preferably strip-shaped first conductor and a web which is inclined with reference to the leg and has an aperture for the connection portion of a threaded fastener (such as the shank of a relatively short screw), the connecting portion being extendable through the respective aperture and into mesh with the registering tapped hole of a second conductor (such as an elongated bus bar in the deepmost portionof an elongated recess provided in a terminal block), and means for confining or retaining each fastener in the region of the respective distancing element. As mentioned above, the first conductor can constitute a relatively narrow and thin metallic strip an elongated edge portion of which defines weakened joints with the legs of the distancing elements so that such legs can be broken off the strip in a predictable manner. The heads of the threaded fasteners are disposed at the first or inner sides of the respective webs, namely, at those sides of the webs which face the first conductor. The second or outer sides of the webs can abut directly against the respective bus bar(s).

Each distancing element can constitute a substantially U-shaped clip further having a second leg which is integral with the respective web. The webs are disposed between the legs of the U-shaped distancing elements, and the confining means can constitute integral parts of the legs or an integral part of at least one leg of each U-shaped distancing element. Otherwise stated, the second leg of each U-shaped distancing element can form part of or may constitute the confining means. For example, the legs of U-shaped distancing elements can have mutually inclined sections adjacent to the respective webs and constituting the respective confining means. Such sections can taper toward each other in a direction away from the respective web.

Alternatively, the distancing elements can constitute substantially L-shaped clips and the confining means then comprises preferably interconnected discrete cages, one for each distancing element and each disposed between the respective leg and the associated web. The cages are preferably hollow insulating bodies of substantially square or rectangular cross-sectional outline defining compartments having open sides facing the respective webs and walls remote from the open sides of the compartments and provided with openings for insertion of tools which are used to rotate the threaded fasteners in order to drive their connecting portions into or to disengage such portions from the corresponding bus bars. The means for interconnecting the cages can comprise an insulating enclosure or envelope for the first conductor, and each cage can be integrally connected with the enclosure by a weakened joint which allows for predictable and convenient separation of the corresponding cage from the enclosure if the distancing element which is adjacent to a given cage is to be broken off the first conductor.

The novel features which are considered as characteristic of the invention are set forth in particular in the appended claims. The improved cross connection link itself, however, both as to its construction and the mode of installing the same, together with additional features and advantages thereof, will be best understood upon perusal of the following detailed description of certain specific embodiments with reference to the accompanying drawing.

BRIEF DESCRIPTION OF THE DRAWING

FIG. 7 is a front elevational view of an additional cross connection link with substantially L-shapd distancing elements, portions of the strip-shaped conductor and of the insulating enclosure therefor being broken away; and FIG. 8 is a sectional view as seen in the direction of arrows from the line VIII—VIII of FIG. 7.

DESCRIPTION OF THE PREFERRED EMBODIMENTS

Figure 1:
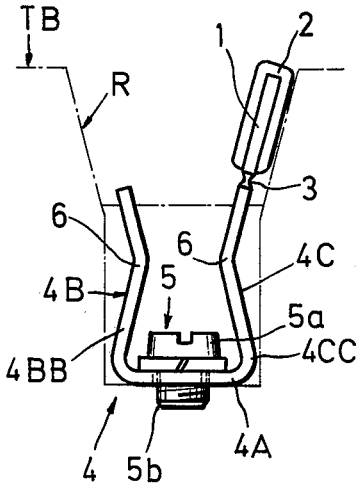
FIG. 1 is an end elevational view of a cross connection link which embodies one form of the invention and employs substantially U-shaped distancing elements, the outline of a recess in the terminal block for the improved link being indicated by phantom lines.
Figure 2:
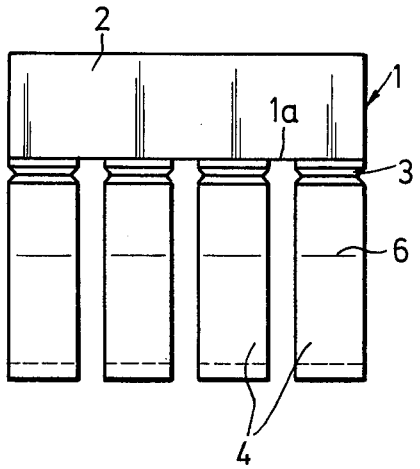
FIG. 2 is a front elevational view of the link as seen from the left-hand side of FIG. 1.

The cross connection link which is shown in FIGS. 1 and 2 comprises an elongated narrow manually manipulatable first conductor in the form of a metallic strip 1 which extends transversely of a row of several identical or similar distancing elements 4 and is surrounded by an enclosure or envelope 2 consisting of electrically insulating material. One longitudinal edge portion 1*a* of the strip 1 is integral with several distancing elements 4 which are connectable with a second conductor in the form of a bus bar BB (see FIG. 5) by discrete threaded fasteners in the form of screws 5. Each distancing element 4 is a substantially U-shaped clip having a first leg 4C which is integral with the edge portion 1*a* of the strip 1, a web 4A whose length at least equals but preferably at least slightly exceeds the diameter of the head 5*a* of the respective screw 5, and a second leg 4B. The joint 3 between the edge portion 1*a* of the strip 1 and the leg 4C of each clip 4 is weakened so as to invariably ensure that a selected clip 4 will be separated from the strip 1 at the respective joint 3 when the operator so desires. Upon completion of preliminary installation, the edge portion 1*a* of the strip 1 is normally located at the lowermost point of the strip so that the clips 4 extend downwardly from (i.e., they are located at a level below) the strip 1. In other words, the legs 4B and 4C are then substantially vertical and the web 4A is substantially horizontal. The dimensions of the clips 4 are selected in such a way that, when the link of FIGS. 1 and 2 is installed in the recess or groove of a modular terminal block TB (the outline of such recess is indicated in FIG. 1 by phantom lines and the recess is denoted by the reference character R), the webs 4A of the clips 4 extend into immediate proximity of the respective bus bar or bus bars BB. The screws 5 serve to separably secure the corresponding clips 4 to the associated bus bars. It will be noted that the head 5*a* of each screw 5 is located within the confines of the corresponding clip 4 (namely, at the inner side of the respective web 4A) and that the legs 4B, 4C of each clip 4 have pairs of mutually inclined sections including the sections 4BB, 4CC which are immediately adjacent to and constitute with the web 4A a cage which confines or retains the screw 5 therewithin so that the screw cannot be lost or misplaced even if its shank 5*b* is completely separated from the tapped portion of the adjacent bus bar. The shanks 5*b* of the screws 5 are or can be relatively short, and they need not come into any contact with the plastic material of the terminal block TB whose recess R is shown in FIG. 1. In other words, the shank 5*b* of each screw 5 can mesh directly with the corresponding bus bar BB while the head 5*a* of such screw bears against the inner side of the respective web 4A. Moreover, the screws 5 do not subject the clips 4 to any twisting and/or other deforming stresses, especially if the length of the webs 4A (as measured in a direction from the section 4BB toward the section 4CC) is selected in such a way that the head 5*a* of each screw 5 bears against a flat central portion of the corresponding web when the shank 5*b* of such screw extends into a tapped bore of the associated bus bar BB. In other words, the width of the flat portion of the web 4A in the region of the aperture for the shank 5*b* at least equals or at least slightly exceeds the diameter of the head 5*a*.

The dimensions of the clips 4 are selected in such a way that, when the clips are received in the corresponding portion of the recess R in the terminal block TB, the strip 1 is spaced apart from and thus cannot contact the customary partitions of the terminal block. This can be ssen in FIG. 8. The partitions extend into the spaces between the neighboring clips 4 but cannot reach the edge portion 1*a* of the strip 1.

The pairs of sections of the legs 4B and 4C are joined to each other at 6, and the distance between such junctions is less than the diameter of the head 5*a* of a screw 5. This ensures that the screws 5 cannot become lost even if their shanks 5*b* are completely detached from the respective webs 4. The distance between the common plane of the junctions 6 and the plane of the web 4A is preferably such that the space which is defined by the web 4A and sections 4BB, 4CC suffices to nearly fully accommodate the corresponding screw 5 while the shank 5*b* of the screw is completely detached from the bus bar.

Figure 3:
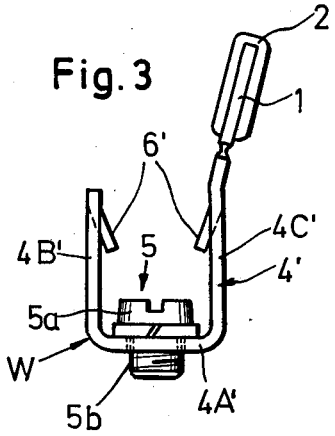
FIG. 3 is an end elevational view of a second cross connection link which employs modified U-shaped distancing elements.

In the embodiment which is shown in FIG. 3, the legs 4B' and 4C' of the slightly modified U-shaped distancing element or clip 4' need not be provided with mutually inclined sections and junctions 6 between such sections. Instead, the substantially flat or straight legs 4B' and 4C' have inwardly extending portions or lugs 6' which are stamped from the material of the respective legs and cooperate with the substantially flat web 4A' to define a confining compartment for the screw 5. The manner in which the strip 1 (which is surrounded by the insulating enclosure or envelope 2) is integrally connected to the upper end portion of the illustrated leg 4C' is the same as described in connection with FIGS. 1 and 2. The distance between the lower edge faces of the lugs 6' and the plane of the web 4A' suffices to ensure that the shank 5*b* of the screw 5 can be completely separated from the respective bus bar (not shown in FIG. 3).

The dimensions of the substantially U-shaped clips 4 and 4' are preferably selected in such a way that they must undergo at least some (preferably a relatively small amount of) deformation in order to be fitted into the recess R of the terminal block TB. This ensures that the preferably elastic clips 4 and 4' tend to expand and thereby bear against the surfaces surrounding the respective recess R with attendant retention of the cross connection link in the terminal block TB even before some or all of the screws 5 are rotated in a direction to move their shanks 5*b* into mesh with the corresponding bus bar or bus bars. This, in turn, facilitates the manipulation of screws 5 during rotation of heads 5*a* to move their shanks 5*b* into or from mesh with the bus bar or bus bars. Such mode of dimensioning the clips 4 and 4' is especially desirable when the terminal block TB is installed overhead so that the open side of its recess R faces downwardly and the workman must rotate the screws 5 in a sense to move their shanks 5*b* upwardly into tapped holes of a bus bar which is located at a level above the webs 4A or 4A'.

Figure 5:
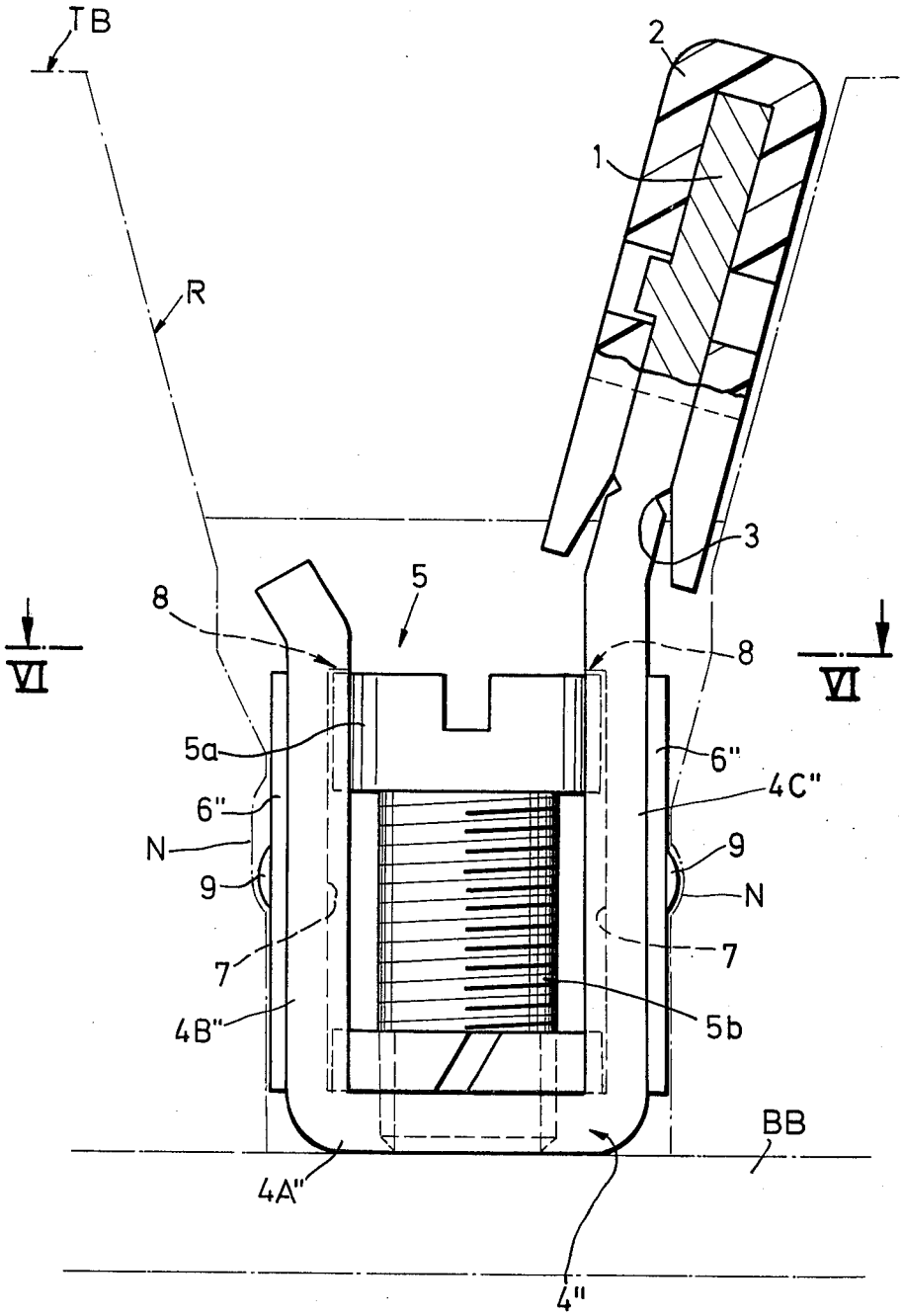
FIG. 5 is a larger-scale partly end elevational and partly transverse vertical sectional view of a further cross connection link with U-shaped distancing elements which are positively held in the recesses of terminal blocks.
Figure 6:
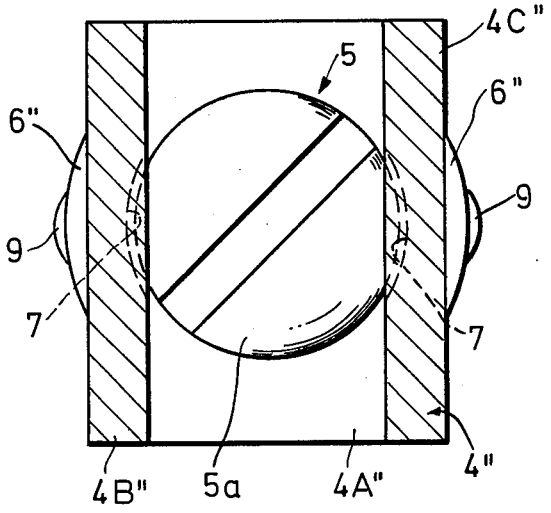
FIG. 6 is a horizontal sectional view as seen in the direction of arrows from the line VI—VI of FIG. 5.

The cross connection link of FIGS. 5 and 6 comprises an elongated metallic strip 1 which is surrounded by an insulating enclosure or envelope 2 and is integrally but separably connected with several substantially U-shaped distancing elements or clips 4'' (only one shown). The legs 4B'' and 4C'' of the illustrated clip 4'' are designed with a view to ensure highly accurate guidance of the head 5*a* of the screw 5 during axial movement of the screw in order to move its shank 5*b* into mesh with the tapped hole of or to disengage the shank 5*b* from the bus bar BB. Moreover, the legs 4B'' and 4C'' are designed to ensure reliable retention of the clip 4'' in the recess R of the terminal block TB, i.e., retention which is more reliable than a mere frictional engagement between the outer sides of the legs 4B'', 4C'' and the surfaces bounding the corresponding portions of the recess R. Such reliable retention of the clips 4'' is especially desirable and advantageous when the open side of the recess R faces downwardly, i.e., when the workman must move the cross connection link upwardly and must rotate the screws 5 in a direction to move the shanks 5*b* into mesh with a bus bar BB at a level above the webs 4A''.

As can be seen in FIGS. 5 and 6, the median portions of the inner sides of the legs 4B'' and 4C'' have aligned straight grooves 7 which are bounded by convex surfaces having radii of curvature corresponding to or approximately the radius of the head 5*a*. Those ends of the grooves 7 which are remote from the web 4A'' are bounded by internal shoulder or stops 8 of the respective legs 4B'' and 4C'' so as to prevent the screw 5 from leaving the confines of the clip 4''. The grooves 7 can be formed by deforming the median portions of the respective legs 4B'' and 4C'' so that such portions bulge outwardly, as at 6''. The central portions of the bulges 6'' are provided with preferably round protuberances 9 which can snap into complementary notches N in the adjacent portions of the surface bounding the recess R in the terminal block TB. The notches N and the corresponding protuberances 9 constitute a simple but reliable detent structure which holds the clip 4'' in the corresponding portion of the recess R regardless of the orientation of the terminal block TB, i.e., irrespective of whether the terminal block is vertical, horizontal, otherwise inclined, located overhead or in such orientation that the open side of the recess R faces upwardly. It will be noted that the legs 4B'' and 4C'' define paths (note the grooves 8) which confine the head 5*a* of the illustrated screw 5 to reciprocatory movement in directions toward and away from the web 4A'', namely, between the inner side of the web 4A'' and the shoulders 8. The distance between the shoulders 8 and the inner side of the web 4A'' is selected in such a way that the shank 5*b* of the screw 5 can be completely detached from the bus bar BB but the screw 5 remains confined in the space between the legs 4B'', 4C'' and the web 4A''.

The cross connection link of FIGS. 7 and 8 comprises substantially L-shaped distancing elements or clips 104 each having a single leg 4*a* and a web 4*b* extending substantially transversely of the leg 4*a*. The upper end portion of the leg 4*a* (as viewed in FIG. 8) is integrally but separably connected with the edge portion 1*a* of the metallic strip 1 by a weakened joint 3 where the entire distancing element 104 can be readily broken away from the strip 1. The central portion of the substantially flat web 4*b* has an aperture 4*bb* for the shank 5*b* of the respective screw 5 whose head 5*a* is confined in a cage 11 forming an integral part of the insulating enclosure or envelope 2' for the strip 1. The shanks 5*b* of the illustrated screws 5 are relatively short and the dimensions of the spaces or compartments 13 which are defined by the respective cages 11 are such that the screws 5 cannot become lost even if their shanks 5*b* are completely detached from the bus bar or bus bars (not shown). When the screws 5 are driven home, their heads 5*a* bear directly against the inner sides of the respective webs 4*b* and their shanks 5*b* mesh directly with the corresponding bus bar(s), i.e., the screws are not in contact with the plastic material of the terminal block TB whose recess R receives the improved device. The inner side of the web 4b of each distancing element 104 is flat, at least in that region which is contacted by the underside of the head 5a when the respective screw 5 meshes with the bus bar at the outer side of the web 4b.

The dimensions of the distancing elements 104 are selected in such a way that, when the cross connection link of FIGS. 7 and 8 is inserted into the recess R, the customry partitions P (one shown in FIG. 8) of the terminal block TB cannot contact the metallic strip 1. To this end, the edge portion 1a of the strip 1 is formed with equidistant first open slots 10 whose width exceeds the thickness of a partition P. The adjacent portions of the partitions P extend, preferably snugly, into narrower second open slots 15 which register with the nearest first slots 10 and are provided in the enclosure 2'.

The cages 11 consist of an insulating material, preferably of the material of the envelope 2'. A discrete cage 11 is provided for each distancing element 104, i.e., for each screw 5. The joints between the cages 11 and the envelope 2' are indicated at 12; these joints can be, and preferably are, weakened so as to ensure that the cages 11 can be broken off the enclosure 2' when the operator so desires. The enclosure completely surrounds the metallic strip 1 so that the latter is fully insulated from the terminal block TB. The provision of a weakened joint 12 between each cage 11 and the enclosure 2' ensures that the operator can separate one or more selected cages 11 in a predictable manner (namely, at the respective joint 12) prior to breaking off the corresponding distancing element 104 at 3.

Each of the illustrated cages 11 is a hollow insulating body having a substantially rectangular cross-sectional outline. The underside of each cage 11 (as viewed in FIG. 8, i.e., that side which faces the inner side of the respective web 4b) is open so that the compartment 13 can receive the head 5a of the respective screw 5. That wall of each cage 11 which is remote from and preferably parallel to the respective web 4b has a preferably circular opening 14 whose diameter is at least slightly smaller than that of a head 5a so as to prevent escape of the screw 5 from the compartment 13. The opening 14 allows for insertion of the working end of a screwdriver or another suitable tool which is used to rotate the screw 5, either to drive the shank 5b into the tapped hole of the corresponding bus bar or to disengage the shank 5b from the bus bar. The diameter of each opening 14 is or can be selected in such a way that it equals or only slightly exceeds the diameter or width of the working end of the aforementioned tool which is used to rotate the screw 5 by entering the diametrically extending slot in the exposed side of the head 5a. Thus, the surface surrounding the opening 14 can be said to constitute a guide for the tool which rotates the head 5a of the screw 5 in the corresponding compartment 13. It has been found that such dimensioning of the opening 14 simplifies the task of an operator who is in charge of connecting some or all of the screws 5 with one or more bus bars.

As mentioned above, the width of the open slots 15 in the envelope 2' can be selected in such a way that each thereof can snugly receive the corresponding marginal portion of a partition P to thereby hold the partition out of contact with the strip 1 while at the same time enhancing the retaining action of the terminal block TB. This is especially advisable and advantageous when the terminal block TB is mounted overhead so that the operator must rotate the screws 5 from below in order to drive the shanks 5b into bus bars which are located at a level above the outer sides of the webs 4b. The provision of slots 15 in the enclosure 2' renders it possible to properly retain the device in the recess R even before any of the screws 5 are driven home and even if the distancing elements 104 are not designed to frictionally engage the adjacent portions of the surface bounding the recess R in the terminal block TB.

The structure which is shown in FIGS. 7 and 8 is preferably assembled in the following way: In the first step, the shanks 5b of the screws 5 are inserted into the respective apertures 4bb, for example, by an automatic inserting system of any known design. In the next step, the enclosure 2' (with its cages 11) is slipped onto the strip 1 so that each cage 11 confines the head 5a of a screw 5. In order to ensure reliable retention of the metallic component (including the strip 1 and its distancing elements 104 with screws 5) in the insulating component (including the enclosure 2' and its cages 11), the two components are preferably provided with cooperating male and female detent members such as spaced-apart holes or bores 16 in the strip 1 and protuberances or lobes 17 at the inner sides of the enclosure 2'. When the strip 1 is properly inserted into the enclosure 2', one or two protuberances 17 snap into each hole 16 to thus reliably but releasably hold the strip 1 in the insulating component.

Figure 4:
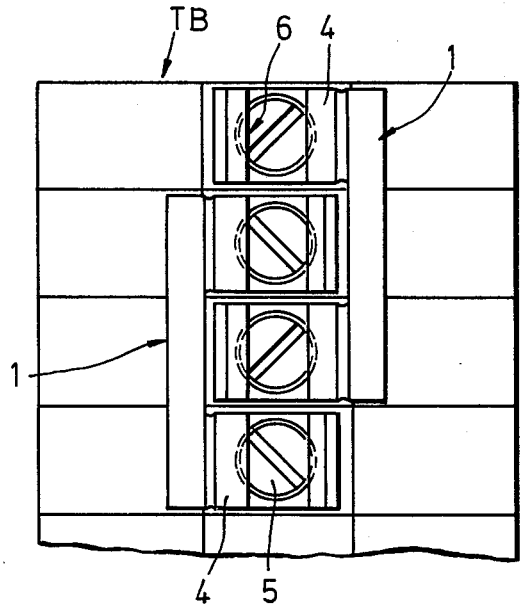
FIG. 4 is a plan view of a terminal battery of blocks with two mirror symmetrical links of the type shown in FIGS. 1 and 2.

As can be readily seen in FIGS. 1, 3, 5 and 8, the configuration and dimensioning of the improved cross connection link are such that the link occupies only a portion of the recess R in the corresponding terminal block TB. Thus, and referring for example to FIG. 1, the strip 1 and its insulating enclosure 2 are adjacent to the surface bounding the right-hand side of the recess R while the left-hand side of this recess remains unoccupied. This renders it possible to install in the recess two or more discrete cross connection links each of which is connectable to a discrete bus bar, i.e., to a discrete source of electrical energy whose characteristics (amperage and/or voltage) deviate from each other. As shown in FIG. 4, the recess of the terminal block TB contains two mirror symmetrical devices each of which has a strip 1 and two U-shaped distancing elements 4. The distancing elements 4 which are integral with one of the strips 1 alternate with distancing elements 4 which are integral with the other strip 1. The unnecessary distancing elements 4 are broken off the respective strips 1 at the corresponding joints or weakened portions 3. Each of the two strips 1 (their insulating enclosures 2 are not identified in FIG. 4) can be installed in one and the same recess of a selected terminal block TB. The potential which is applied to the left-hand strip 1 of FIG. 4 is or can be different from the potential which is applied to the right-hand strip 1.

If a recess R is to accommodate several strips 1 with substantially L-shaped distancing elements 104 of the type shown in FIGS. 7 and 8, the webs 4b of distancing elements 104 on one of the strips can overlie and contact the webs 4b of distancing elements 104 on the other strip 1 in one and the same recess. In other words, each web 4b can be electrically connected with several strips 1. Such arrangement can be useful when the full rated current is to be applied to the distancing elements. It is evident that two or more strips 1 with L-shaped distancing elements 104 can be installed in a common recess R in a manner which is analogous to that shown in FIG. 4, i.e., so that the elements 104 which are integral with one of the strips alternate with the elements 104 which are integral with the other strip, and the unnecessary distancing elements 104 are broken away (preferably together with the corresponding cages 11).

It is further within the purview of the invention to construct each substantially U-shaped distancing element 4, 4' or 4'' in such a way that one of its legs (preferably the leg 4B, 4B' or 4B'') can be separated from the corresponding end of the associated web 4A, 4A' or 4A''. As indicated in FIG. 3, the U-shaped clip 4' can be weakened at W, e.g., in the same way as shown for the joints 3 or 12, so as to allow for convenient and predictable separation of the leg 4B, 4B' or 4B'' from the remainder of the respective clip 4, 4' or 4'', i.e., to convert an originally U-shaped distancing element or clip into a substantially L-shaped distancing element. Such separability of the legs 4B, 4B' and/or 4B'' is desirable and advantageous under circumstances which were explained above in connection with the embodiment of FIGS. 7 and 8, i.e., when a full rated current is to be applied to L-shaped distancing elements each of which is connected or connectable with several metallic strips 1.

An important advantage of the improved cross connection link is that its components, especially the current-conducting component including the strip 1 and the U-shaped or L-shaped distancing elements which are integral with its edge portion 1*a*, can be mass-produced in simple stamping and bending machines.

Another important advantage of the improved cross connection link is that it can employ threaded fasteners in the form of screws having short or very short connecting portions or shanks 5*b* which must extend only through the apertures of the respective webs and directly into the tapped holes of bus bars which are adjacent to the outer sides of the webs. This prevents the establishment of any contact between the fasteners 5 and the plastic material of the terminal block TB. Moreover, the screws 5 or analogous fasteners cannot apply any appreciable deforming stresses to the material of the terminal block since the heads 5*a* bear directly against the inner sides of the respective webs whose outer sides, in turn, are urged directly against the adjacent bus bars.

A further important advantage of the improved cross connection link is that several strips 1 can be accommodated in one and the same recess R in a manner as described in connection with FIG. 4. This renders is possible to apply different voltages to selected distancing elements and strips 1 in one and the same recess.

The L-shaped distancing elements are simpler than the U-shaped distancing elements. However, the U-shaped distancing elements exhibit the advantage that their portions or sections can constitute the confining means for the corresponding fasteners. The configurations of legs 4B, 4C or 4B', 4C' or 4B'', 4C'' are sufficiently simple to allow for mass-production of the corresponding distancing elements 4, 4' or 4'' in machines which are not much more complex than those which are used for the making of devices having L-shaped distancing elements 104.

It is clear that the enclosure 2' of FIGS. 7 and 8 could constitute a separate or discrete component performing solely the function of the enclosure 2 shown in FIG. 1; the cross connection link which is shown in FIGS. 7 and 8 then comprises discrete means for interconnecting the neighboring cages 11 as well as suitable means for coupling such interconnecting means with the enclosure for the strip 1 or with the respective L-shaped distancing elements 104. The arrangement which is shown in FIGS. 7 and 8 is preferred at this time because it contributes to simplicity and lower cost of the cross connection link. The exact composition of the insulating material of the enclosure 2, 2' and/or cages 11 forms no part of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A cross connection link for establishing the same electrical phase between several terminal blocks having electric bars, comprising an elongated conductor; a plurality of distancing elements each having a leg integral with said conductor and a web inclined with reference to said leg and having an aperture; threaded fasteners, one for each of said distancing elements and each having a connecting portion extendable through the respective aperture and into meash with the electric bar of the respective terminal block; and means for confining each fastener in the region of the respective distancing element.

2. The link of claim 1, wherein each of said webs has a side facing said first conductor and a second side, each of said threaded fasteners including a screw having a shank which constitutes said connecting portion of the respective screw and a head, said head being disposed at the first side of the respective web.

3. The link of claim 1, wherein each of said webs has a side facing said conductor and a second side, each of said fasteners comprising a shank constituting the respective connecting portion and a head adjacent to the first side of the respective web, said apertures extending between the first and second sides of the respective webs and said first sides including flat portions surrounding the respective apertures and being dimensioned in such a way that, when the shank of a screw extends through the respective aperture, the head of such screw bears against the flat portion at the first side of the respective web.

4. The link of claim 1, wherein each of said distancing elements is a substantially U-shaped clip further having a second leg integral with the respective web, each second leg and the respective web defining a weakened portion where the second leg can be broken off the respective web.

5. The link of claim 1, wherein said distancing elements are substantially U-shaped clips each of which further includes a second leg integral with the respective web, said webs being disposed between the respective legs and said legs having mutually inclined sections defining junctions spaced apart from the respective webs and together constituting the respective confining means.

6. The link of claim 1, wherein each of said distancing elements is a substantially U-shaped clip further having a second leg which is integral with the respective web, said webs being disposed between the respective pairs of legs and said legs being elastically deformable to move nearer to or further away from each other, and further comprising a terminal block having a recess arranged to receive said distancing elements in at least slightly deformed condition of the respective legs so that the legs bear against the terminal block and thereby hold said link in the recess.

7. The link of claim 1, wherein said distancing elements are substantially L-shaped clips and said confining means comprises a discrete cage for each of said clips, said cages being disposed between the legs and webs of the respective clips and said confining means further comprising means for interconnecting said cages, said interconnecting means comprising an enclosure consisting of electrically insulating material and said conductor including a narrow metallic strip which is surrounded by said enclosure.

8. The link of claim 1, wherein said distancing elements include L-shaped clips and said confining means comprises a discrete cage for each of said clips, said confining means further comprising an elongated enclosure consisting of electrically insulating material and at least partially confining said conductor, said cages having portions defining weakened joints with said enclosure so that any selected cage can be readily broken off said enclosure at the respective joint.

9. The link of claim 1, further comprising an enclosure for said first conductor, said enclosure having open slots disposed between neighboring distancing elements and further comprising a terminal block having a recess for said distancing elements and partitions having portions snugly received in said slots so that said enclosure is releasably held by such partitions.

10. The link of claim 1, wherein said conductor is a relatively narrow metallic strip having an elongated edge portion defining weakened joints with the legs of said distancing elements.

11. The link of claim 10, wherein each of said legs has a first end portion remote from the associated web and defining the respective weakened joint with said edge portion and a second end portion remote from the respective joint and integral with the associated web.

12. The link of claim 1, wherein each of said distancing elements is a substantially U-shaped clip further having a second leg, the webs of said clips being disposed between the respective legs and said confining means including the second legs of the respective clips.

13. The link of claim 12, wherein the legs of each of said clips have sections adjacent to the respective webs and forming part of the respective confining means.

14. The link of claim 12, wherein said sections of the legs of each of said clips are included with reference to each other and taper toward each other in a direction away from the respective webs.

15. The link of claim 1, wherein each of said distancing elements is a substantially L-shaped clip and said confining means comprises interconnected cages, one for each of said clips.

16. The link of claim 15, wherein each of said webs has a side facing said first conductor and a second side, said fasteners including threaded shanks constituting said connecting portions and heads adjacent to the first sides of the respective webs, said cages defining compartments for the heads of the respective screws.

17. The link of claim 15, wherein said confining means further comprises an elongated connecting element integral with all of said cages and at least partially surrounding said conductor.

18. The link of claim 1, wherein said distancing elements are substantially U-shaped clips each of which further includes a second leg integral with the respective web, said webs being disposed between the respective legs and at least one leg of each of said clips having a lug extending toward the other leg of the respective clip and constituting therewith the respective confining means.

19. The link of claim 18, wherein each leg of each of said clips has a lug and the lugs of each clip together constituting the respective confining means.

20. The link of claim 1, wherein each of said distancing elements is a substantially U-shaped clip further having a second leg integral with the respective web, said webs being disposed between the respective pairs of legs and the legs of each clip having inner sides facing toward and outer sides facing away from each other, each of said fasteners comprising a shank constituting the respective connecting portion and a head disposed between the respective legs, the inner side of at least one leg of each of said clips having an elongated groove constituting the respective confining means and receiving a portion of the respective head so that the head is movable toward and away from the respective web.

21. The link of claim 20, wherein the outer side of said one leg of each of said clips has a bulge registering with the corresponding groove.

22. The link of claim 20, wherein said one leg of each of said clips has a stop which limits the extent of movement of said portion of the head of the respective screw in the corresponding groove.

23. The link of claim 20, wherein the outer side of at least one leg of each of said clips has a protuberance and further comprising a terminal block having a recess for said distancing elements and a surface bounding said recess, said surface having notches for said protuberances so as to releasably retain said distancing elements in the recess.

24. The link of claim 23, wherein said outer side of each leg which exhibits a protuberance has a bulge in register with the respective groove and said protuberances are provided on the respective bulges.

25. The link of claim 1, further comprising an enclosure for said conductor, said enclosure consisting of electrically insulating material and said conductor and said enclosure together defining at least one detent structure for releasably holding said conductor in said enclosure.

26. The link of claim 25, wherein said detent structure comprises at least one protuberances provided on said enclosure, said conductor having a hole receiving at least a portion of said protuberance.

27. The link of claim 1, wherein said distancing elements are substantially L-shaped clips and said confining means includes a discrete cage for each of said clips, each of said cages being disposed between the web and the leg of the respective clip and each of said fasteners comprising a screw including a shank constituting the respective connecting portion and a head disposed within the confines of the respective cage, each cage having an opening affording access to the head of the respective screw.

28. The link of claim 27, wherein said cages consist of an electrically insulating material.

29. The link of claim 27, wherein said openings are bounded by substantially cylindrical surfaces of the respective cages and the diameters of said heads exceed the diameter of the respective openings.

30. The link of claim 29, wherein each of said cages defines a compartment for the respective head and said openings communicate with the respective compartments.

31. The link of claim 27, wherein each of said cages defines a compartment for the respective head, said compartments having open sides adjacent to the respective webs and walls remote from the respective webs and provided with said openings.

32. The link of claim 31, wherein said confining means further comprises means for connecting said cages to each other.

33. The link of claim 31, wherein each of said cages has a substantially rectangular cross-sectional outline.

* * * * *